US008875939B2

(12) United States Patent
Phillips et al.

(10) Patent No.: US 8,875,939 B2
(45) Date of Patent: Nov. 4, 2014

(54) STORAGE DEVICE WITH HINGED LID

(71) Applicant: Suncast Technologies, LLC, Palm Beach Gardens, FL (US)

(72) Inventors: William Phillips, Batavia, IL (US); Michael Vogler, Oswego, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 74 days.

(21) Appl. No.: 13/709,772

(22) Filed: Dec. 10, 2012

(65) Prior Publication Data

US 2014/0158702 A1 Jun. 12, 2014

(51) Int. Cl.
*B65D 43/16* (2006.01)
*B65D 43/24* (2006.01)

(52) U.S. Cl.
CPC ..... *B65D 43/24* (2013.01)
USPC ..... 220/832; 220/831

(58) Field of Classification Search
USPC ..... 220/831, 832, 833, 834; 206/335; 27/18
See application file for complete search history.

(56) References Cited

U.S. PATENT DOCUMENTS 1,056,996 A * 3/1913 Isaacson et al. ..... 40/313
1,303,441 A * 5/1919 Wilton ..... 217/60 C
1,335,626 A * 3/1920 Villinger ..... 217/60 C
1,796,551 A * 3/1931 Wismer ..... 217/60 C
2,587,200 A * 2/1952 Nottingham ..... 217/60 C
2,691,463 A * 10/1954 De Santis et al. ..... 220/88.1
2,707,064 A * 4/1955 Castello ..... 217/60 R
3,060,546 A * 10/1962 Nelson ..... 27/18
3,101,226 A * 8/1963 Cochran, Jr. ..... 312/265.5
4,524,496 A * 6/1985 Tehsildar et al. ..... 27/18
4,925,223 A * 5/1990 Craft ..... 292/339
5,224,744 A * 7/1993 Michelutti ..... 292/234
5,484,092 A * 1/1996 Cheney ..... 224/404
5,570,493 A * 11/1996 Gulick ..... 27/18
5,704,476 A * 1/1998 Abbott ..... 206/386
5,778,604 A * 7/1998 Snow ..... 52/66
5,788,064 A * 8/1998 Sacherer et al. ..... 206/204
5,860,554 A * 1/1999 Ruffo ..... 220/832
5,868,448 A * 2/1999 Izumo ..... 296/37.1
5,897,014 A * 4/1999 English ..... 220/263
6,012,253 A * 1/2000 Burns ..... 52/79.5
6,138,855 A * 10/2000 Kopf ..... 220/263
6,267,240 B1 * 7/2001 Callaway ..... 206/373
6,332,554 B1 * 12/2001 McCarthy ..... 220/554
6,347,818 B1 * 2/2002 Lyons, Sr. ..... 292/271
6,364,152 B1 * 4/2002 Poslinski et al. ..... 220/788
6,371,231 B1 * 4/2002 Nushii et al. ..... 180/69.21
6,398,067 B1 * 6/2002 Belfance et al. ..... 220/833
6,772,904 B1 * 8/2004 Gilliam et al. ..... 220/836
6,932,396 B2 * 8/2005 Masseth et al. ..... 292/338

(Continued)

*Primary Examiner* — Fenn Mathew
*Assistant Examiner* — Christopher McKinley
(74) *Attorney, Agent, or Firm* — McHale & Slavin, P.A.

(57) ABSTRACT

A storage unit having sidewalls and a lid hinged to a sidewall. A support device has one end mounted to the lid and one end received in a track recessed in a sidewall and operable to follow in a travel path defined by the track when the lid is raised and lowered. The track having a rest surface on which the end of the support device in the track can rest to support the lid in the open position. The storage unit can include a latch assembly associated with a sidewall and the lid to selectively secure the lid in a closed position.

9 Claims, 6 Drawing Sheets

(56) References Cited

U.S. PATENT DOCUMENTS

| | | | | |
|---|---|---|---|---|
| 7,004,349 | B2 * | 2/2006 | Heiberg et al. | 220/827 |
| 7,028,859 | B2 * | 4/2006 | Moon et al. | 220/4.28 |
| 7,665,601 | B2 * | 2/2010 | Portier | 206/204 |
| 7,891,478 | B2 * | 2/2011 | Gunst et al. | 194/350 |
| 8,480,141 | B2 * | 7/2013 | Lee | 292/338 |
| 2004/0200832 | A1 * | 10/2004 | Moon et al. | 220/4.28 |
| 2004/0206759 | A1 * | 10/2004 | Busch | 220/315 |
| 2004/0232021 | A1 * | 11/2004 | Linton | 206/335 |

* cited by examiner

STORAGE DEVICE WITH HINGED LID

FIELD OF INVENTION

A storage unit with a hinged lid. A support device is provided to selectively support the lid in an open position, the support device is self actuating to move between a position to hold the lid open and a position allowing the lid to be closed without requiring a person to manipulate the support device. A self actuating latch is also provided for releasably securing the lid in a closed position.

BACKGROUND OF THE INVENTION

Storage devices for storing items out of sight are well known. One popular form of such a device is used for outdoor storage, that is, the device is outdoors and the contents stored in the device are out of the weather. They are in essence, a small storage shed with one or more doors for access through a sidewall and can have a roof that is hinged to function as an access lid. Thus, two means of accessing the interior of the storage device are provided. Such devices can be large, six feet or more in width, four feet or more in depth and five feet or more in height at the door. Typically, the roof or lid is inclined for water runoff.

In order to effectively use the lid as an access means, some support device is needed to selectively hold the lid in an open position and that can be manipulated to allow closing of the lid. Such support devices are known in the art for use on toy boxes and storage chests but either require manual manipulation by a user or the application of closing force to effect closing movement of the lid. On a large storage unit, this presents difficulty since a person opening a lid may not be able to reach the support device in order to manipulate it. Further, on wide storage units it would be difficult to stand in one position and operate a support device on each of both sides of the unit when two support devices are used. Air springs could be provided as supports reducing or eliminating the need for manual manipulation to permit lid closing because they are connected at both ends, but they require force to move to a closed position placing stress on the units at connection points and hinges. Also, the weather conditions when outside can make the operation of support devices unreliable.

When the lid is closed, it is desired to provide means to releasably retain it in a closed position. Latches are known for accomplishing this, but they are difficult to use to effect latching and use of a security locking device to prevent unauthorized access.

There is thus a need for an improved storage device construction.

SUMMARY

The present invention involves the provision of a storage device such as an outdoor storage shed or chest. The storage device includes a plurality of wall members associated with one another to form sidewalls. The wall members define an interior adapted for storing items. Some of the wall members define a top opening, one of said wall members being a first wall member and having a recessed track in an interior surface. The track forms a travel path, the track includes a seat along the path. A lid is hingedly associated with at least one of the wall members adjacent a hinged edge portion and is movable between a closed position closing the top opening and an open position at least partially exposing the top opening allowing access to the interior. The lid has opposite edge portions extending from the hinged edge portion. A support prop has a first end portion pivotally mounted to the lid adjacent a respective lid edge portion and a second end portion received within the track and has its movement relative to the first wall member guided by the track and operable to selectively engage the seat to hold the lid in the open position and move into engagement with the seat under downwardly directed force on the prop.

BRIEF DESCRIPTION OF THE DRAWINGS

Like numbers used throughout this application represent like or similar parts and/or construction.

DETAILED DESCRIPTION OF THE INVENTION

Figure 1:
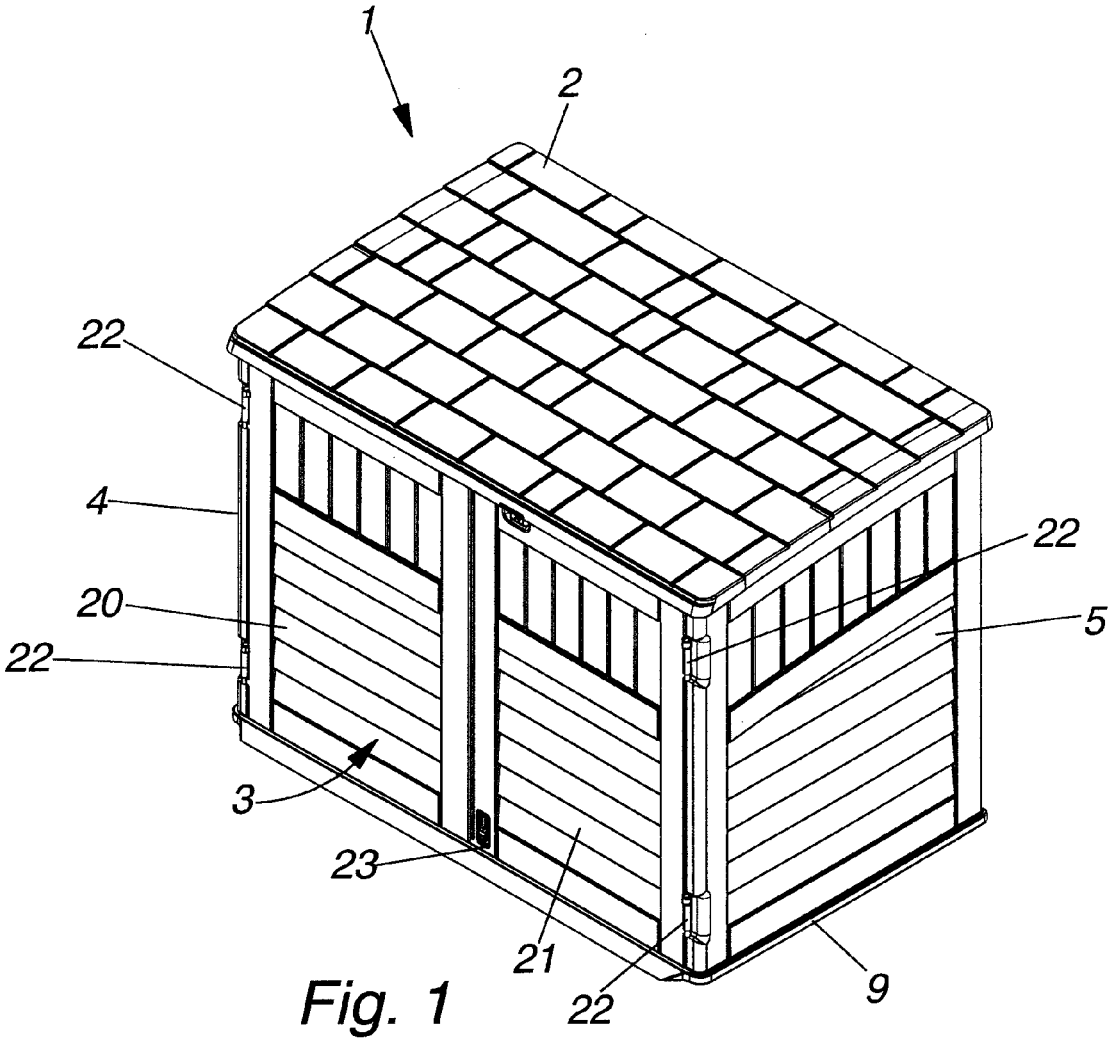
FIG. 1 is a perspective view of a storage device shown with a lid in a closed position.

The reference numeral 1 designates generally a storage device such as an outdoor shed or chest that has an access member which is shown as a lid 2 that moves between an up or open position and a down or closed position. The storage device 1 includes upstanding wall members 3, 4, 5, 6 associated with one another to form sidewalls for the storage device. A floor 9 may also be provided. The illustrated storage device 2 is a generally rectangular solid in exterior shape. As the storage device 1 and its parts are described herein, the storage device 1 would be on a substantially level support such as the ground with lid 2 being hinged at the rear of the storage device, that is, its normal orientation for use. The lid 2 and walls 3-6 define an interior storage space 11 and the walls 3-6 have upper edges 12, 13, 14, 15 respectively defining an access opening 19. Any suitable material and construction method may be used to form the walls 3-6 and the lid 1 and they are preferably formed with a polymeric material as by blow molding and are hollow. The wall 3 can be in the form of a plurality of door segments 20, 21 each hingedly mounted to a respective wall 4, 5 as with hinges 22 and be selectively secured in a closed position by a latch 23.

Figure 2:
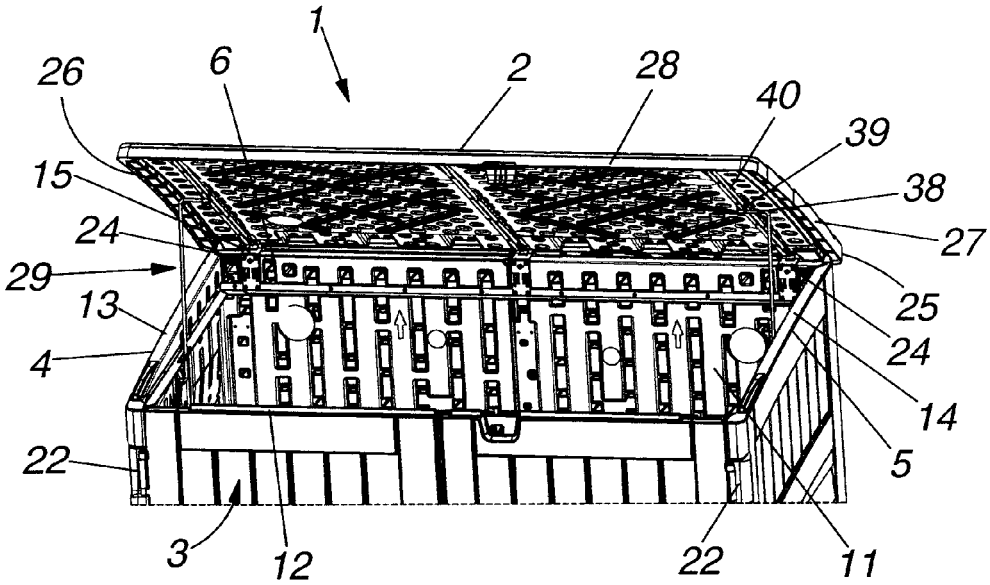
FIG. 2 is an enlarged fragmentary perspective view of the storage device with the lid shown in an open position.

The lid 2 is hingedly mounted to the back wall 6 as with hinges 24 positioned adjacent edges 15 and 25 and suitably secured to the lid 2 and wall 6. The lid can be selectively moved between a closed position (FIG. 1) and an open position (FIG. 2). The lid 2 also has opposite side edges 26, 27 extending forwardly of the edge 25 to a front edge 28.

Figure 3:
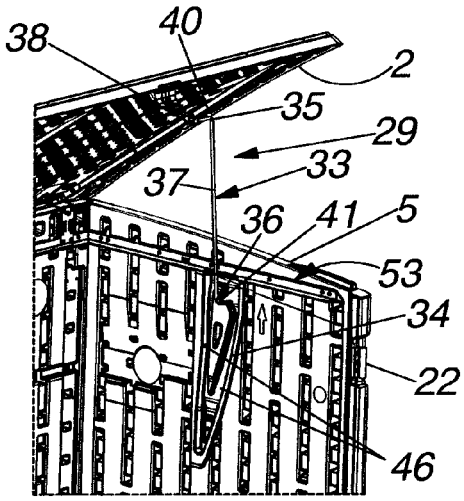
FIG. 3 is an enlarged fragmentary view of an end portion of the storage device.

The storage device 1 includes means 29 for selectively holding the lid 2 in an open position as best seen in FIG. 3. The means 29 includes a support prop 33 and a guide track 34 recessed in a wall member and as shown, side wall member 5 and opens into the interior 11. When a pair of support props 33 is used, there is also a track 34 in sidewall member 4. The prop 33 has opposite end portions 35, 36 and an intermediate bight portion 37. The upper end portion 35 has a finger 38 extending from the bight 37 preferably at a right angle. The finger 38 is pivotally mounted to the lid 2, FIG. 2, adjacent the respective edge 26, 27 of the lid 2. As shown, the finger 38 pivots in a clip 39 secured to a bracket 40 which in turn is suitably secured to the lid 2. A push nut or the like can be use to retain the finger 38 to the clip 39. The bight 37 depends downwardly from the lid and terminates in the end portion 36 that has a follower 41 projecting from the bight 37 at a right angle and is received in the track 34.

Figure 4:
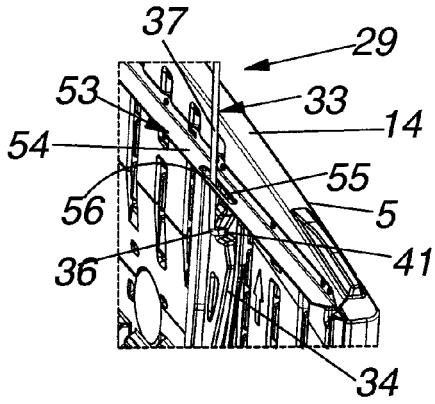
FIG. 4 is an additionally enlarged fragmentary perspective view of the end portion seen in FIG. 3.
Figure 5A:
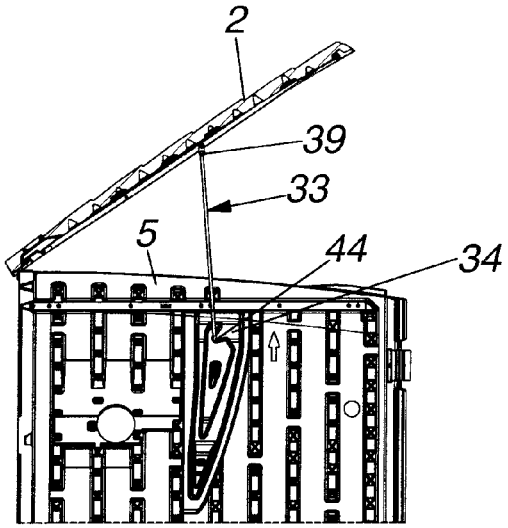
FIGS. 5A-E are fragmentary side elevation views of an end wall member showing various positions of a support prop in various position of movement in a track.

Referring to FIGS. 5A-E for operation of the prop 33. The track 34 defines a travel path for the follower 41 to follow along during opening and closing movement of the lid 2 and to provide a seat 44 to support and retain the prop 33 in a position to hold the lid 2 in an open position. The travel path is in the form of a continuous groove loop. The loop has a pair of legs 45, 46 forming an apex 47 where the legs join together at a lower portion of the track 34. The legs 45, 46 diverge upwardly from the apex 47. The leg 46 is a forward positioned leg and the leg 45 being a rear positioned leg relative to the back wall 6. The track 34 has a connecting leg 48 extending between upper portions of the forward and rear positioned legs 46, 45 respectively. The seat 44 is in the connecting leg 48. The seat 44 has a generally upwardly facing surface 49 that is preferably inclined downwardly from front to rear to induce movement of the follower 41 from front to rear during closing movement of the lid 2 to a partially open position as seen in FIG. 5A and retain the lid 2 in that position. The seat 44 also includes a pocket 50 at the junction of the surface 49 and a generally upstanding surface 51. The prop 33 and the follower 41 are retained against lateral movement during rest and movement of the lid 2. They are also retained in a manner that prevents the lid 2 from opening too far and thereby allow the follower 41 to leave the track 34. As best seen in FIGS. 3, 4, a retainer 53 is provided and is positioned between the lid 2 and an upper portion of the track 34. The retainer 53 is associated with the track 34 and closes the travel path loop. The retainer 53 includes a bracket 54 with a through elongate slot 55. The bight 37 is positioned in the slot 55 and is allowed to move up and down and forwardly and rearwardly during opening and closing movement of the lid 2 as described below. The inside edge 56 restricts inward movement of the bight 37 from the slot and retains the follower 41 in its respective inwardly opening track 34. The bracket 54 acts as a stop to prevent the follower 41 from exiting the track 34 during upward movement thereof.

Figure 5B:
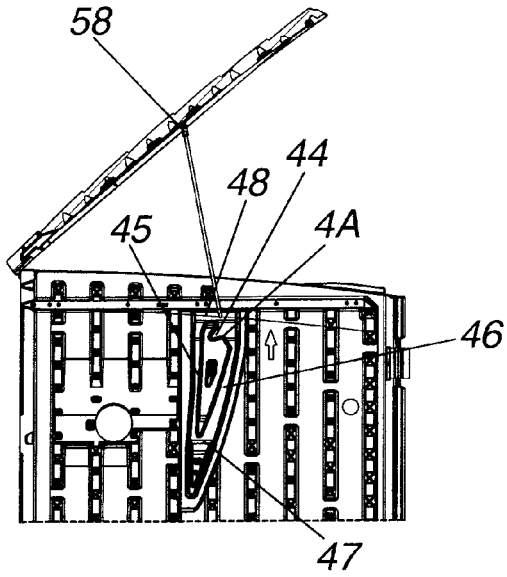
Figure 5C:
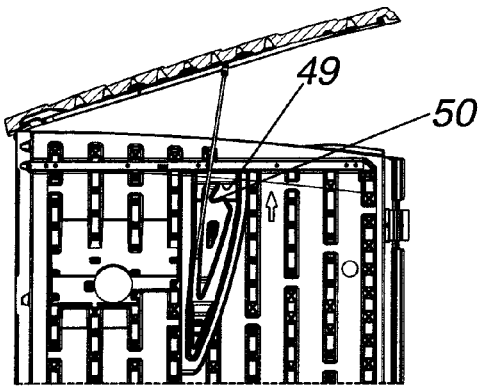
Figure 5D:
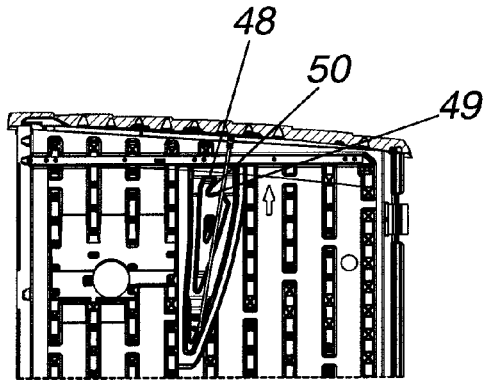
Figure 5E:
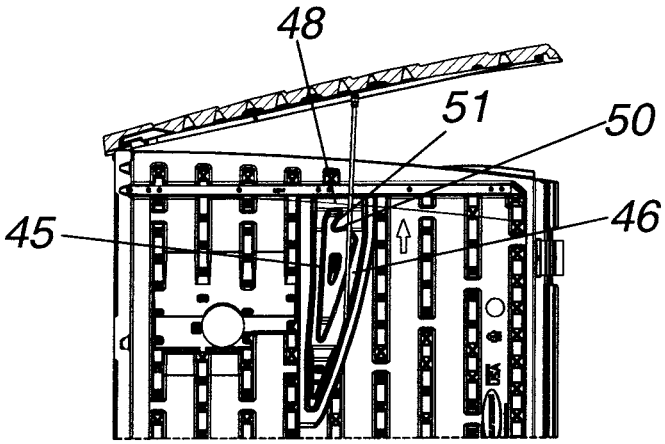

The follower 41 and prop 33 function as follows and as best seen in FIGS. 5A-E. The lid 2 is in its open and supported position as seen in FIG. 5A with the follower retained in the pocket 50. This allows the lid to be supported in an open position and a person to gain access to the interior storage space 11 without having to hold the lid 2 open. When the lid is in its supported open position of FIG. 5A, it is preferred that the pivot axis 58 of the finger 38 on the lid 2 is above or forward (toward the front edge 28 of the lid 2) of the follower 41 when the follower is in the pocket 50. To close the lid 2, upward movement of the lid 2 is made as shown in FIG. 5B which moves the pivot axis 58 rearwardly (toward the rear or hinged edge of the lid 2) whereby the downward force of gravity induces the follower 41 to move rearwardly to a position over an upper open end of the leg 45. Closing or downward movement of the lid 2 results in the follower 41 moving downwardly through the leg 45 while the pivot axis 58 moves forwardly as seen in FIG. 5C. The follower 41 then moves into the apex 47 and under the lower end of the leg 46 as seen in FIG. 5D. In this position, the pivot axis 58 is forward of the follower as is the bight 37. The lid 2 is in a closed position. To open the lid 2, the front edge 28 thereof is moved upwardly with gravity inducing the prop 33 to be in an orientation that the follower 41 will move upwardly through the leg 46 and out of its upper open end, FIG. 5E. The pivot axis 58 is moving rearwardly during this upward movement of the lid 2 to a position above or rearward of the seat 44 so that the orientation of the bight 37 induces movement of the follower 41 into the pocket 50 under the influence of gravity. Gravity provides a downwardly directed force on the prop 33 to induce it to operate as described.

In a preferred embodiment, there is a means 29 at each of the opposite ends of the storage device 1 as seen in FIG. 2. The construction of the means 29 a shown, allows a user of the storage device 1 to open and close the lid 2 without the user having to manually interact with the means 29 to operate them other than move the lid 2 up and down.

Figure 6:
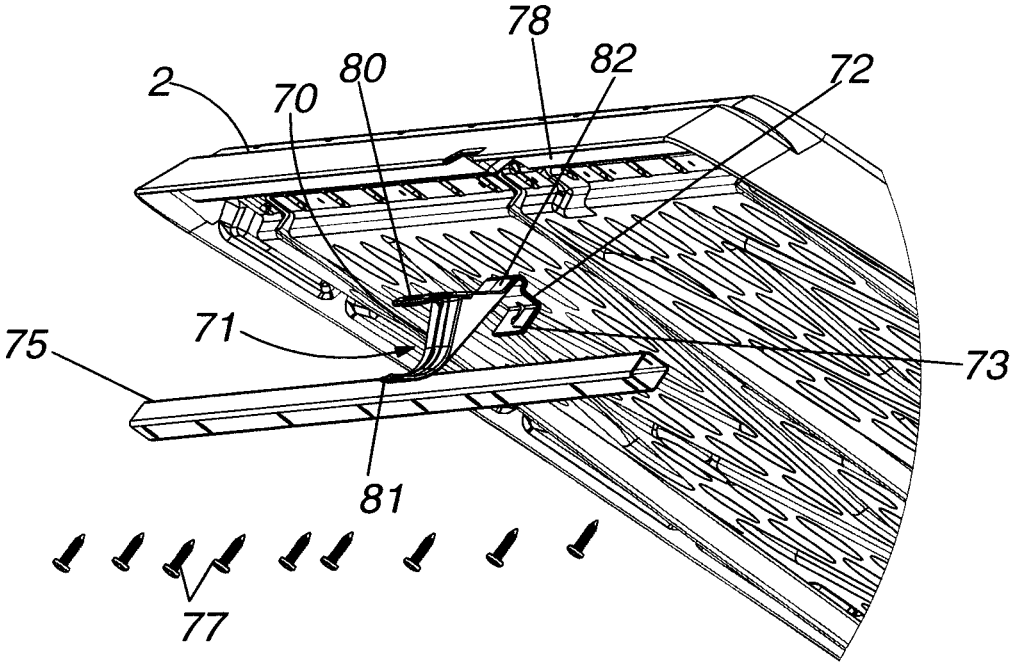
FIG. 6 is an enlarged exploded perspective view of a latch assembly.
Figure 7:
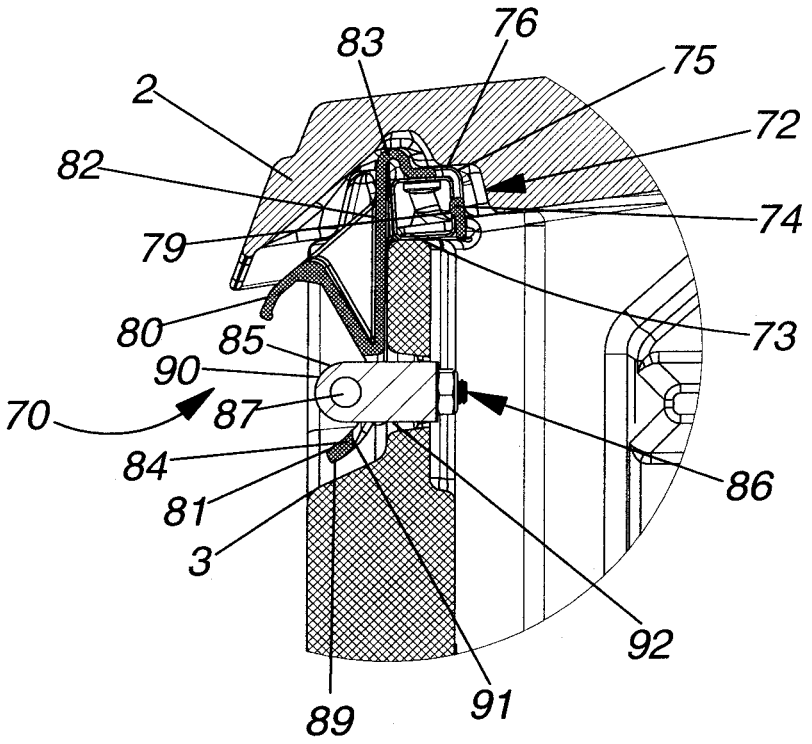
FIG. 7 is an enlarged sectional perspective view of the latch assembly shown with the lid closed.

The storage device 2 can also be provided with a self securing latch assembly, designated generally as 70, and is best seen in FIGS. 6, 7. The latch assembly 70 cooperates with the lid 2 and front wall member 3 for selectively securing the lid 2 in a closed condition. The latch assembly 70 includes a latch member 71 mounted to the lid 2. As shown, the latch member 71 has a channel section 72 with an open side 73 with the channel 72 opening away from the lid 2. A bar 75 is received in the channel 72 fixing a channel wall 76 between the bar and the lid 2. The channel 72 can be provided with a detent 74 that extends through an opening 79 in the bar 75 to help fix the position of the bar and channel relative to one another. The bar 75 is secured to the inside of the lid 2 with suitable fasteners 77 such as push pins or threaded fasteners. As shown, the channel 72 can be positioned in a pocket 78 recessed in the lid 2.

The latch member 71 includes a handle portion 80 and a catch portion 81 connected to the handle portion. The handle 80 extends outwardly from the catch 81 and a hinge section 82. The handle 80 is connected to the channel 72 by a resiliently deformable hinge section 82 allowing the handle 80 and catch portion 81 to be selectively moved relative to the lid 2. Preferably, the latch member 71 is of an integrally formed construction and more preferably of a molded construction and made of a resiliently deformable polymer. The catch portion 81 is also movable forwardly and rearwardly relative to the wall member 3 to effect latching when the lid 2 is closed or moving to a closed position. The catch portion 81 is provided with a through opening 84 sized, shaped and positioned to receive a hasp 85 therethrough. The hasp 85 is secured to the wall member 3 as with a threaded fastener assembly 86 such a bolt and locking nut. The hasp 85 projects forwardly of the outer surface of the wall member 3. When the lid 2 is closed, the hasp 85 extends through the opening 84 exposing a through hole 87 adapted to have a security device such as a padlock (not shown) cooperate with the hasp to prevent operation of the latch member 71 and permit opening of the lid 2. The channel 72 can utilize a portion of the hinge 82 as one of its sidewalls. A portion 83 of the channel 72 extends between the wall 76 and the hinge portion 82 and is generally U-shaped in transverse cross section and extends outwardly from the wall 76 as seen in FIG. 7.

The catch 81 and the hasp 85 are configured relative to one another to allow them to move by one another and thereby effect outward movement of the catch 81 and allow the hasp to move into the opening 84. As shown, the catch 81 has a sloped or inclined cam surface 89 that inclines upwardly and inwardly from a free end of the catch 81 and faces generally rearwardly toward the wall member 3. The hasp 85 has a curved end surface 90. As shown, the end 90 is rounded, adapted to engage the surface 89 whereby closing movement of the lid 2 urges the surfaces 89, 90 into engagement and urging the catch 81 to move outwardly and allow the hasp 85 to enter the opening 84 which then allows the catch to move rearwardly and secure the lid 2 closed by interference between a bottom edge surface 91 of the opening 84 and a bottom edge 92 of the hasp 85. To open the lid, the handle 80 is moved to effect movement of the catch 81 to a position where the hasp 85 is free of interference with the surface 91 allowing the lid 2 to be moved to an open position.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

It is to be understood that while certain forms of the invention are illustrated and described, it is not to be limited to the specific forms or arrangements herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A storage device including:

a plurality of wall members associated with one another to form sidewalls of a storage device with an interior adapted for storing items, at least some of said wall members defining a top opening, one of said wall members being a first wall member and having a recessed track in an interior surface, said track forming a travel path, said track including a seat along said path, said travel path opening into the interior and being in the form of a loop, said seat having a surface portion facing generally upwardly, said track having a pair of travel path legs connecting at and diverging from a lower portion of the track and forming an apex at the lower track portion, one said leg being a forward positioned leg and the other being a rear positioned leg, said track having a connecting leg extending between upper portions of the forward and rear positioned legs, said seat being in the connecting leg;

a lid hingedly associated with at least one of said wall members adjacent an edge portion of said wall member and movable between a closed position closing said top opening and an open position at least partially exposing the top opening allowing access to the interior, said lid having opposite edge portions extending from the hinged edge portion; and a prop having a first end portion pivotally mounted to the lid adjacent a respective said edge portion and a second end portion received within said track and having its movement relative to said first wall member guided by said track and operable to selectively engage said seat to hold said lid in said open position and move into engagement with the seat under downwardly directed force on said second end portion.

2. The storage device as set forth in claim 1 including a latch assembly cooperating with the lid and a second said wall member and operable for selectively securing the lid in said closed position.

3. The storage device of claim 2 wherein the latch assembly including a latch member mounted to the lid and having handle portion and a catch portion, said latch member being resiliently deformable to allow the catch portion to move forwardly and rearwardly relative to the said second wall member when the lid is in a closed position, said catch portion having a through first opening, said latch assembly also including a hasp secured to the second wall member and projecting therefrom and when the lid is in the closed position, the hasp extending through said first opening.

4. The storage device of claim 3 wherein the catch portion having an inclined cam surface facing the second wall member when the lid is in the closed position said inclined cam surface sloping inwardly and upwardly in a direction from a free end of the catch portion, said through opening providing a catch surface for selective engagement with the hasp to selectively limit opening movement of the lid.

5. The storage device of claim 1 wherein the prop having the first end portion pivotally mounted to the lid with a pivot axis at a position that is forward of the apex when the lid is in its closed position and rearward of an upper open end of the rear positioned leg when the lid is in an open position.

6. The storage device of claim 5 including a retainer secured to the first wall member and having a portion positioned between the lid and the track, said retainer having an elongate through opening with a portion of the prop extending therethrough and operable for preventing the prop second end portion from leaving the track.

7. The storage device of claim 6 wherein the seat including a rest surface and a pocket extending upwardly from the rest surface.

8. The storage device of claim 7 including a second said support device and a second said track recessed in a third wall member, a second said seat and a second said retainer secured to the third wall member.

9. A storage device with a latch mechanism for selectively securing a access member in a closed position, the storage device including:

a plurality of wall members and an access member associated with the wall members defining a storage interior, said access member being selectively movable relative to a first said wall member between open and closed positions and when in an open position providing access to the storage interior, said first wall member and having a recessed track in an interior surface, said track forming a travel path, said track including a seat along said path, said travel path opening into the interior and being in the form of a loop, said seat having a surface portion facing generally upwardly, said track having a pair of travel path legs connecting at and diverging from a lower portion of the track and forming an apex at the lower track portion, one said leg being a forward positioned leg and the other being a rear positioned leg, said track having a connecting leg extending between upper portions of the forward and rear positioned legs, said seat being in the connecting leg, a prop having a first end portion pivotally mounted to said access member adjacent a respective said edge portion thereof and a second end portion received within said track and having its movement relative to said first wall member guided by said track and operable to selectively engage said seat to hold said access member in said open position and move into engagement with the seat under downwardly directed force on said second end portion; and a latch assembly associated with the access member and said first wall member to selectively prevent opening movement of the access member, the latch assembly including a hasp secured to and projecting from one of said access member and said first wall member and a latch member secured to the other of the access member and said first wall member, the latch member including a hinge portion connected to a handle portion and a catch portion connected to the handle portion, said hinge portion being operable to permit resilient movement of the handle portion and the catch portion relative to the hasp and at least one of the access member and the first wall member, the catch portion having a cam surface selectively engageable with the hasp and a through opening operable to selectively receive the hasp therethrough and selectively secure the latch member in a latched configuration.

* * * * *